US009435231B2

(12) United States Patent
Sengul

(10) Patent No.: US 9,435,231 B2
(45) Date of Patent: Sep. 6, 2016

(54) METHOD FOR OPERATING AN INTERNAL COMBUSTION ENGINE WITH ELECTROHYDRAULIC VALVE CONTROL MEANS

(71) Applicant: Schaeffler Technologies GmbH & Co. KG, Herzogenaurach (DE)

(72) Inventor: Emin Sengul, Nuremberg (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 14/416,422

(22) PCT Filed: Jul. 24, 2013

(86) PCT No.: PCT/DE2013/200072

§ 371 (c)(1),
(2) Date: Jan. 22, 2015

(87) PCT Pub. No.: WO2014/015869

PCT Pub. Date: Jan. 30, 2014

(65) Prior Publication Data

US 2015/0176439 A1 Jun. 25, 2015

(30) Foreign Application Priority Data

Jul. 24, 2012 (DE) ..... 10 2012 212 989

(51) Int. Cl.
*F01L 9/02* (2006.01)
*F01L 1/24* (2006.01)

(52) U.S. Cl.
CPC ..... *F01L 1/24* (2013.01); *F01L 9/021* (2013.01); *F01L 9/025* (2013.01)

(58) Field of Classification Search
CPC ..... F01L 1/24; F01L 9/021; F01L 9/025
USPC ..... 123/90.12, 90.13, 90.16
See application file for complete search history.

(56) References Cited

U.S. PATENT DOCUMENTS 4,664,070 A 5/1987 Meistrick et al.
5,537,976 A 7/1996 Hu (Continued)

FOREIGN PATENT DOCUMENTS

EP 1344900 9/2003
EP 1378636 1/2004

(Continued)

*Primary Examiner* — Ching Chang
(74) *Attorney, Agent, or Firm* — Volpe and Koenig, P.C.

(57) ABSTRACT

A method for operating an internal combustion engine (4) with an electrohydraulic valve train (1) for variable-lift drive of a gas exchange valve (3), including a camshaft (6) and a hydraulic system arranged in a drive path between the camshaft and the gas exchange valve, said hydraulic system being connected to a pressure medium supply (14) of the internal combustion engine, a first hydraulic piston (8) which is driven by a cam (5) of the camshaft and a second hydraulic piston (9) which drives the gas exchange valve in an opening direction, a variable-volume pressure chamber (10) which is delimited by the hydraulic piston and a control channel (12) which connects the pressure chamber to a pressure relief chamber (11), an electrically actuated hydraulic valve (15) which is arranged in the control channel and which, in an open position, permits a flow of hydraulic medium through the control channel and, in a closed position, blocks a flow of hydraulic medium through the control channel, and an electronic controller (16) for the actuation of the hydraulic valve as a function of operating parameters of the internal combustion engine. To improve the cold-start behavior of the internal combustion engine, it is provided that, during the starting phase, the hydraulic valve is closed and opened again at least once between two immediately successive lifts of the first hydraulic piston.

2 Claims, 2 Drawing Sheets

(56) References Cited

U.S. PATENT DOCUMENTS

| | | | | |
|---|---|---|---|---|
| 8,813,696 | B2 * | 8/2014 | Choi | F01L 13/0005 123/90.11 |
| 2003/0154938 | A1 | 8/2003 | Vattaneo et al. | |
| 2010/0326384 | A1 | 12/2010 | Vattaneo | |
| 2012/0240886 | A1 | 9/2012 | Von Schimonsky et al. | |

FOREIGN PATENT DOCUMENTS

| | | |
|---|---|---|
| EP | 1378637 | 1/2004 |
| EP | 1555398 | 7/2005 |
| EP | 2204566 | 7/2010 |
| WO | 2011069836 | 6/2011 |

* cited by examiner

METHOD FOR OPERATING AN INTERNAL COMBUSTION ENGINE WITH ELECTROHYDRAULIC VALVE CONTROL MEANS

The invention relates to a method for operating an internal combustion engine to improve starting behavior.

BACKGROUND

From WO 2011/069836 A1, a method according to the class for operating an internal combustion engine is known. Here, during a cold start phase of the internal combustion engine, a gas-exchange valve lift required for the charge exchange should be regulated within a minimum lift height and a maximum closing time. For this purpose, a hydraulic valve is switched so that only a partial volume is filled with pressurized medium in a pressure chamber and thus the gas-exchange valve is only partially actuated.

SUMMARY

The objective of the invention is to advantageously refine the method according to the class for improving the starting behavior and especially the cold start behavior of an internal combustion engine.

The objective is met by a method according to the invention.

The proposed method is to operate an internal combustion engine with an electrohydraulic valve train for the variable-lift drive of a gas-exchange valve that is spring loaded in the closing direction. The electrohydraulic valve train includes a camshaft and a hydraulic system arranged in the drive sense between the camshaft and the gas-exchange valve. The hydraulic system is connected to a pressure medium supply of the internal combustion engine. A first hydraulic piston is driven by a cam of the camshaft. The gas-exchange valve is driven in the opening direction by a second hydraulic piston. A pressure chamber is provided between the hydraulic pistons. A control channel connects the pressure chamber to a pressure relief space. An electrically controlled hydraulic valve that allows a flow of pressurized medium through the control channel in the open position of the hydraulic valve and blocks this flow of pressurized medium in the closed position is arranged in the control channel. The hydraulic valve is controlled by an electronic control means as a function of operating parameters of the internal combustion engine. During a startup phase, in particular, during a cold start phase of the internal combustion engine, the hydraulic valve is closed and opened again at least once between two immediately successive lifts of the first hydraulic piston.

During the startup phase, the hydraulic valve closed during a lift of the first hydraulic piston can also be opened again before a maximum lift of the gas-exchange valve.

By closing and opening the hydraulic valve between two immediately successive lifts of the first hydraulic piston, the refilling of the pressure chamber with pressurized medium is improved. Furthermore, through the opening and closing of the hydraulic valve between two immediately successive lifts, the hydraulic system is heated up, because electrical energy of the electrically controlled hydraulic valve is converted into heat energy and fed to the valve piston, the valve seat of the hydraulic valve, and the pressurized medium.

BRIEF DESCRIPTION OF THE DRAWINGS

The invention will be explained in more detail using embodiments shown in FIGS. 1 to 3. Shown are.

DETAILED DESCRIPTION OF THE PREFERRED EMBODIMENTS

Figure 1:
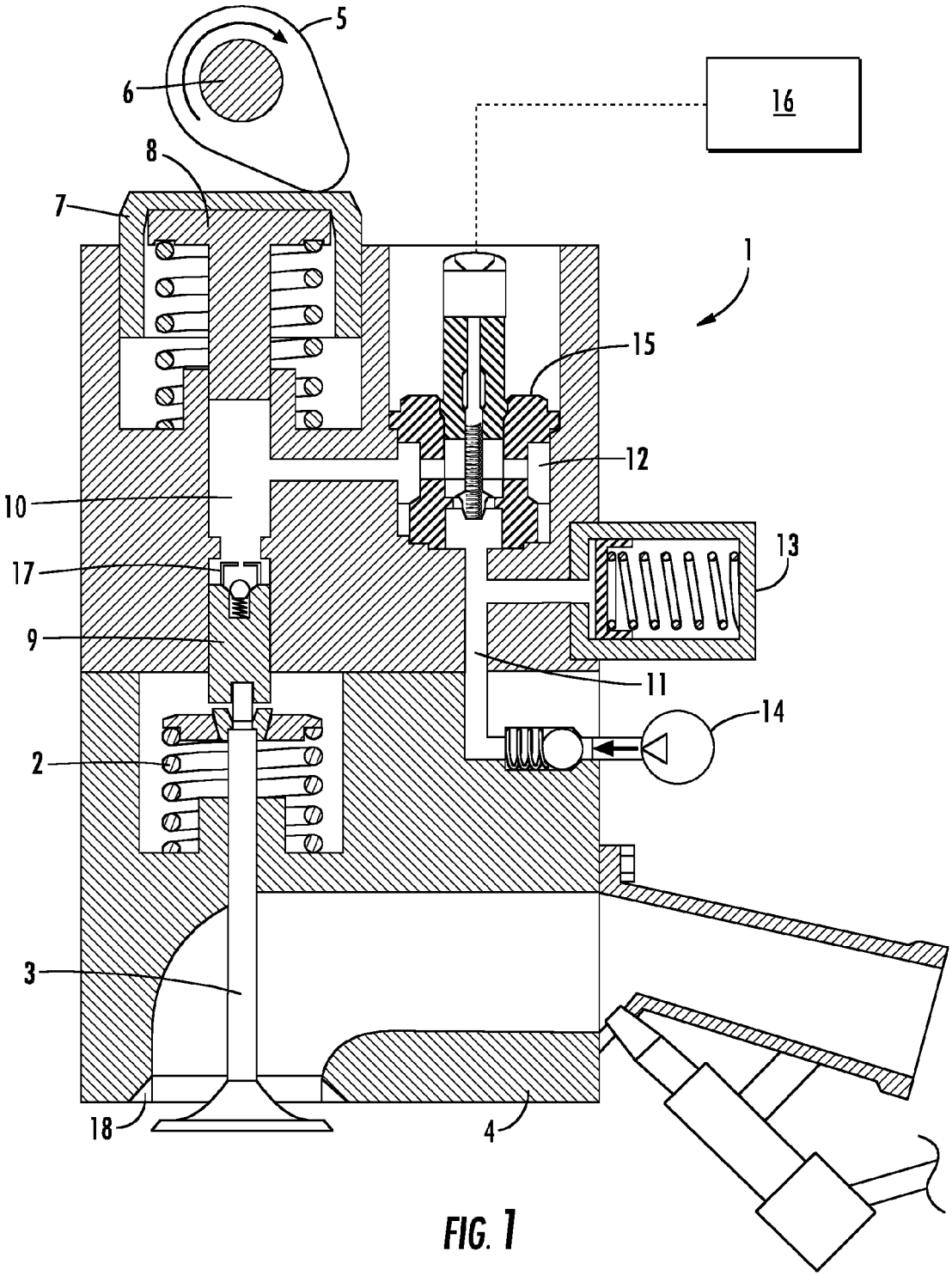
FIG. 1 a section through a valve train for performing the proposed method.

FIG. 1 shows a principle diagram of a known electrohydraulic valve train 1. The valve train 1 is used for the variable-lift drive of a gas-exchange valve 3 spring-loaded by a valve spring 2 in the closing direction in an internal combustion engine 4. The cam 5 that drives the first hydraulic piston 8 by means of the bucket tappet 7 is arranged on the camshaft 6. The second hydraulic piston 9 drives the gas-exchange valve 3 in the form of an intake or exhaust valve in its opening direction. Between the first hydraulic piston 8 and the second hydraulic piston 9, the pressure chamber 10 is formed with variable volume and a pressure relief space 11. The pressure relief space 11 is connected to the pressure chamber 10 by means of the control channel 12 and contains the spring-loaded pressure accumulator 13. The hydraulic system arranged in the drive sense between the camshaft 6 and the gas-exchange valve 3 is connected to the pressurized medium supply 14 of the internal combustion engine 4 and here to its lubricant circuit.

In the control channel 12, the electrically driven hydraulic valve 15 is arranged with the construction as a 2/2-way switching valve. The hydraulic valve 15 is open in the de-energized state and allows a flow of pressurized medium through the control channel 12. In the energized state, the hydraulic valve 15 blocks the control channel 12. The electrical driving of the hydraulic valve 15 is performed as a function of operating parameters of the internal combustion engine 4 by means of the electronic controller 16. The controller 16 can be integrated into the engine control unit.

The known function of the valve train 1 can be combined to the extent that the pressurized medium located in the pressure chamber 10 acts as a hydraulic lever. The lift of the first hydraulic piston 8 provided by the cam 5 is transferred when the hydraulic valve 15 is closed to the gas-exchange valve 3 by means of the second hydraulic piston 9. When the hydraulic valve 15 is open, the pressurized medium is shifted partially or completely into the pressure relief space 11. The hydraulic decoupling of the cam lift and the gas-exchange valve lift requires the hydraulic valve brake 17 that throttles the pressurized medium forced back from the second hydraulic piston 9 and thus decelerates the closing gas-exchange valve 3 to a mechanically and acoustically acceptable setting speed on the valve seat 18.

Figure 2:
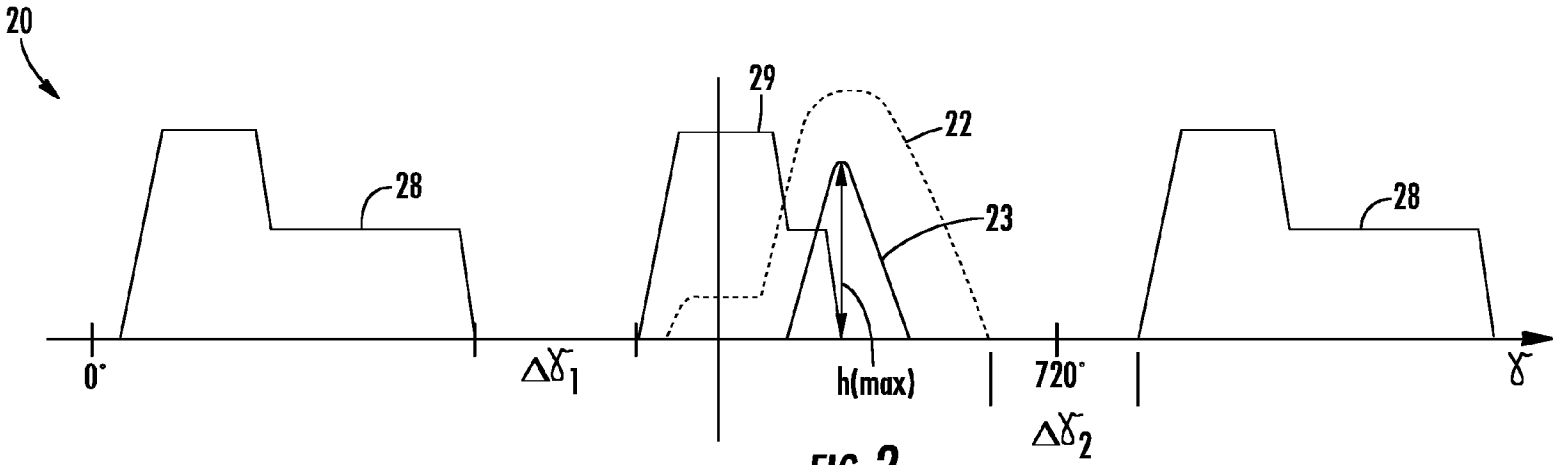
FIG. 2 a sequence of the valve train behavior for a crankshaft angle range shown section by section in a time window close to the startup phase, and FIG. 3 a sequence similar to the sequence of FIG. 2 in a later time window of the startup phase.
Figure 3:
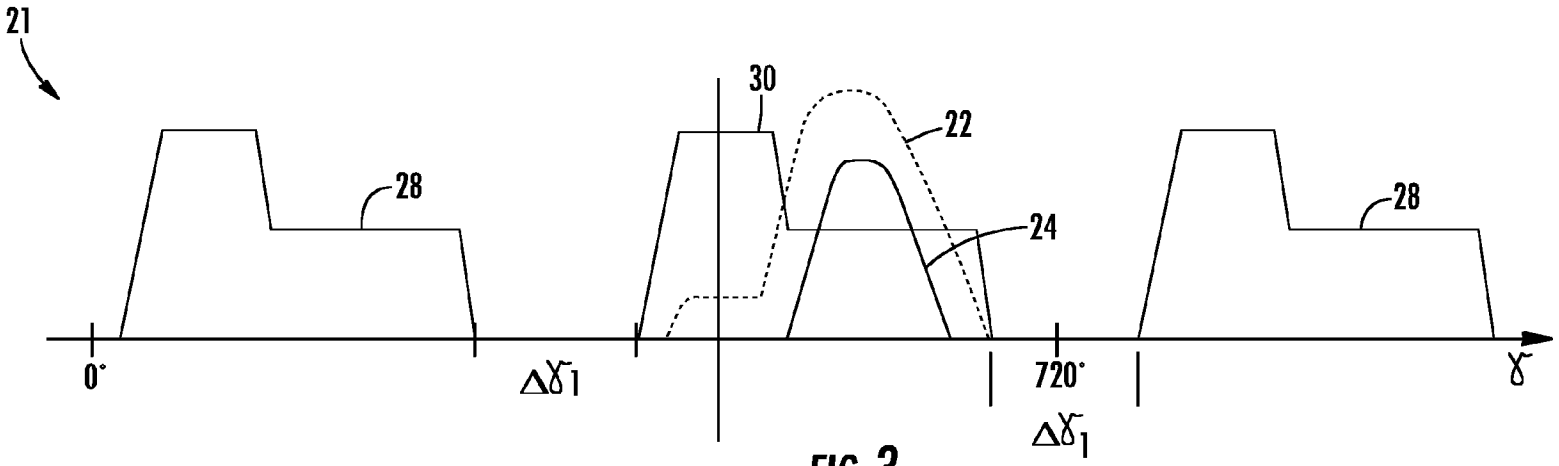

With reference to the valve train 1 of FIG. 1, the sequences 20, 21 shown in FIGS. 2 and 3 over the crankshaft angle $\gamma$ are explained in more detail. These each show the profile 22 of the lift of the first hydraulic piston 8 and the profiles 23, 24 of the lift of the gas-exchange valve 3 and the profiles of the energizing processes 28, 29, 30 of the hydraulic valve 15 during a startup phase of the internal combustion engine 4. FIG. 2 shows the sequence 20 that is applied during the first crankshaft revolutions during the cold start of the internal combustion engine 4. Here, the hydraulic valve 15 is closed by means of the energizing process 28 between two immediately successive lift profiles 22, 23 and is then reopened in the angle range $\Delta\gamma_1$. During the engagement of the cam 5 on the first hydraulic piston 8, the hydraulic valve 15 is closed by means of the energizing process 29. Before the maximum lift h(max) of the gas-exchange valve 3, the energizing process is switched off and the hydraulic valve 15 is reopened, so that the gas-exchange valve 3 remains open only over a shortened angle range. Due to pressure changes in the pressure chamber 10, this is at least partially emptied and refilled when the hydraulic valve 15 is still open due to the changes in pressure in the angle range $\Delta\gamma_2$ that extends in the base circle of the cam 5 up to the new energizing process 28 of the hydraulic valve 15. The closing and opening processes caused by f the energizing processes 28 between two immediately successive lifts of the first hydraulic piston 8 lead to an improved filling of the pressure chamber 10 that is largely independent of the viscosity of the pressurized medium in connection with the refilling of the pressure chamber 10 used in the angle ranges $\Delta\gamma_1$. Furthermore, the energizing processes of the hydraulic valve 15 often performed for each camshaft revolution causes a heating up of the hydraulic system during the startup phase of the internal combustion engine 4.

FIG. 3 shows the sequence 21 that is performed as an alternative to the sequence 20 or after performing a specified number of sequences 20 of FIG. 2 over a specified number of camshaft revolutions. In contrast to sequence 20, the sequence 21 has a longer energizing process 30 during the entire lift of the first hydraulic piston 8. In this way, the gas-exchange valve 3 remains open longer and angle ranges $\Delta\gamma_1$ limited consistently by two energizing processes 28, 30 are set for refilling the pressure chamber 10.

It is understood that the number of energizing processes 28 between two immediately successive lifts of the first hydraulic piston 8, the extent of the angle ranges $\Delta\gamma_1$, $\Delta\gamma_2$, and the period of the energizing process 29 can be adapted to parameters of the internal combustion engine, the pressurized medium, and the valve train.

LIST OF REFERENCE NUMBERS

1 Valve train
2 Valve spring
3 Gas-exchange valve
4 Internal combustion engine
5 Cam
6 Camshaft
7 Bucket tappet
8 First hydraulic piston
9 Second hydraulic piston
10 Pressure chamber
11 Pressure relief space
12 Control channel
13 Pressure accumulator
14 Pressurized means supply
15 Hydraulic valve
16 Electronic controller
17 Hydraulic valve brake
18 Valve seat
20 Sequence
21 Sequence
22 Profile
23 Profile
24 Profile
28 Current profile
29 Current profile
30 Current profile
h(max) Maximum lift
$\gamma$ Crankshaft angle
$\Delta\gamma_1$ Angle range
$\Delta\gamma_2$ Angle range

The invention claimed is:

1. A method for operating an internal combustion engine with an electrohydraulic valve train for a variable-lift drive of a gas-exchange valve that is spring-loaded in a closing direction, comprising providing a camshaft and a hydraulic system arranged in a drive sense between the camshaft and the gas-exchange valve and that is connected to a pressurized medium supply of the internal combustion engine, with a first hydraulic piston driven by a cam of the camshaft and a second hydraulic piston driving the gas-exchange valve in an opening direction, and a pressure chamber limited by the first hydraulic piston and the second hydraulic piston with variable volume and a control channel connecting the pressure chamber to a pressure relief space, arranging an electrically controlled hydraulic valve in the control channel and allowing a flow of hydraulic medium through the control channel in an open position of the hydraulic valve and blocking said flow of the hydraulic medium in a closed position of the hydraulic valve, controlling the hydraulic valve with an electronic controller as a function of operating parameters of the internal combustion engine, and during a startup phase of the internal combustion engine, closing the hydraulic valve and reopening the hydraulic valve at least once between two immediately successive lifts of the first hydraulic piston.

2. The method according to claim 1, further comprising during the startup phase, reopening the hydraulic valve closed during a lift of the first hydraulic piston before a maximum lift (h(max)) of the gas-exchange valve.

* * * * *